US008727837B2

(12) United States Patent
Weder

(10) Patent No.: US 8,727,837 B2
(45) Date of Patent: May 20, 2014

(54) ROTATABLE DISC HEAD AS WELL AS FLOOR TREATMENT MACHINE COMPRISING SUCH DISC HEAD

(75) Inventor: James Weder, Sedona, AZ (US)

(73) Assignee: Design Technologies LLC, Bellevue, WA (US)

( * ) Notice: Subject to any disclaimer, the term of this patent is extended or adjusted under 35 U.S.C. 154(b) by 400 days.

(21) Appl. No.: 13/110,608

(22) Filed: May 18, 2011

(65) Prior Publication Data

US 2011/0306280 A1 Dec. 15, 2011

(30) Foreign Application Priority Data

Jun. 9, 2010 (EP) ..... 10165385

(51) Int. Cl.

| | |
|---|---|
| ***B24B 23/00*** | (2006.01) |
| ***B24B 7/00*** | (2006.01) |
| ***B24B 7/18*** | (2006.01) |
| ***B24B 41/047*** | (2006.01) |

(52) U.S. Cl.

CPC . *B24B 7/00* (2013.01); *B24B 7/186* (2013.01); *B24B 41/047* (2013.01)

USPC ..... 451/353; 451/350

(58) Field of Classification Search

CPC ..... B24B 7/18; B24B 7/186; B24B 7/224; B24B 7/00; B24B 41/047

USPC ..... 451/28, 294, 342, 347, 353, 354, 357, 451/359, 360, 366

See application file for complete search history.

(56) References Cited

U.S. PATENT DOCUMENTS

| | | | | | |
|---|---|---|---|---|---|
| 1,000,696 | A | * | 8/1911 | Schuleter | 451/353 |
| 1,928,390 | A | * | 9/1933 | Myers | 451/353 |
| 1,932,319 | A | * | 10/1933 | Myers | 451/353 |
| 2,171,060 | A | * | 8/1939 | De Spirt | 451/353 |
| 2,290,215 | A | * | 7/1942 | Stenberg | 403/328 |
| 2,673,996 | A | * | 4/1954 | Gerber | 15/49.1 |
| 3,464,166 | A | * | 9/1969 | Bouvier | 451/548 |
| 4,219,898 | A | * | 9/1980 | Presby | 15/49.1 |
| 4,319,434 | A | * | 3/1982 | Brejcha | 451/353 |
| 4,328,645 | A | * | 5/1982 | Sauer | 451/359 |
| 4,939,872 | A | * | 7/1990 | Revelin et al. | 451/354 |
| 5,720,071 | A | * | 2/1998 | Hall | 15/236.08 |
| 5,863,241 | A | * | 1/1999 | Rottschy | 451/271 |

(Continued)

FOREIGN PATENT DOCUMENTS

| | | | | |
|---|---|---|---|---|
| EP | 1985876 | A1 * | 10/2008 | B24B 7/18 |
| GB | 832321 | | 4/1960 | |

*Primary Examiner* — Lee D Wilson
*Assistant Examiner* — Tyrone V Hall, Jr.
(74) *Attorney, Agent, or Firm* — The Webb Law Firm

(57) ABSTRACT

A rotatable disc head for a floor treatment device includes a pair of coupling members which are pivotably connected to each other according to pivot axes which are transversely oriented with respect to each other. A rotation axis is defined which is transversely oriented with respect to the pivot axes. The coupling members are furthermore connected to each other by means of at least one elastically deformable connection element. One of the coupling members includes fitting means for mounting the coupling member to the rotary drive of the floor treatment device and the other coupling member includes carrier means onto which a floor treatment element, such as a grinding disc, can be mounted. The connection of the connection elements to one of the coupling members is an adjustable connection allowing displacements which are oriented transversely with respect to the rotation axis.

12 Claims, 3 Drawing Sheets

(56) References Cited

U.S. PATENT DOCUMENTS 5,903,950 A * 5/1999 Lavin ..... 15/172
5,979,000 A * 11/1999 Gansow ..... 15/49.1
2004/0082285 A1* 4/2004 Bohler ..... 451/359
2006/0025059 A1* 2/2006 Gueorguiev et al. ..... 451/350

* cited by examiner

ROTATABLE DISC HEAD AS WELL AS FLOOR TREATMENT MACHINE COMPRISING SUCH DISC HEAD

BACKGROUND OF THE INVENTION

1. Field of the Invention

The invention is related to a rotatable disc head for a floor treatment device, having a pair of coupling members which are pivotably connected to each other according to pivot axes which are transversely oriented with respect to each other, a rotation axis being defined which is transversely oriented with respect to said pivot axes, said coupling members being furthermore connected to each other by means of at least an elastically deformable connection element, wherein one of the coupling members includes fitting means for mounting said coupling member to the rotary drive of the floor treatment device and the other coupling member includes carrier means onto which a floor treatment element, such as a grinding disc, can be mounted.

2. Description of Related Art

Such a rotatable disc head is disclosed in GB-A-832321. The coupling members thereof are connected to each other through a ball joint which allows pivotal movements according to mutually perpendicular pivot axes. Furthermore, the coupling members are connected to each other through a centrally located helical spring. Said prior art rotatable disc head has the disadvantage that the ball joint has a limited torque capacity; moreover the centrally located spring, the purpose of which is to maintain a desired orientation of the ball joint components with respect to each other, has a limited capacity for redress of said components.

A further rotatable disc head is disclosed in EP-A-1985876. Said prior art rotatable disc head is provided with a universal coupling the coupling members of which are mutually connected through elastic dampers. Said elastic dampers are rigidly connected to both of the coupling members. As a result of these rigid connections, the elastic dampers are deformed not only in compression as is desired for obtaining the damping effect, but also in directions transverse with respect to the compression direction. As a result of these transverse deformations, undesired effects occur within the rotatable disc head. The pivots of the universal coupling are loaded by transverse forces as well, leading to vibrations and accelerated wear of both the universal coupling as well as of the elastic dampers.

SUMMARY OF THE INVENTION

The object of the invention is to provide a rotatable disc head of the type described before which does not have these negative effects. This object is achieved in that a connection between a connection element and a coupling member is an adjustable connection which allows displacements which are oriented transversely with respect to the rotation axis.

The rotatable disc head according to the invention provides the possibility to adjust the floor treatment element with respect to the surface to be treated. In this way, it is ensured that the floor in question is treated in a proper, constant manner, Furthermore, the connection elements provide the desired damping action between the coupling members. The behavior of the connecting elements is dictated by the compression or extension which these connecting elements experience as a result of the pivoting movements of the coupling members with respect to each other. The tilted positions which the coupling members experience with respect to each other do not impose unpredictable deformations on the connecting elements. This results from the possibility of the connecting elements to adjust their position with respect to the coupling member.

The adaptability of the connection member position with respect to the coupling member can be ascertained in different ways. According to a preferred possibility, an adjustable connection of a connection element and a coupling member comprises a slit. The end of the connection member which is closest to the slit is able to slide along the coupling member according to the direction of the slit. By selecting the proper orientation of the slit, the best adaptability of the connection member with respect to said coupling member can be ascertained. For instance, the slit may be oriented perpendicular with respect to one of the pivot axes. Also, the slit may be oriented obliquely with respect to the pivot axes, for instance at an angle of 45 degrees.

The connection element is preferable able to transfer both compression as well as traction loads between the coupling members. This can for instance be achieved in an embodiment wherein a connection element comprises a relatively narrow neck bordered by a widened body and a widened head, and one of the coupling members has a slit the width of which is smaller than the width of the body and the head, said slit slideably accommodating the relatively narrow neck of the connection element. When loaded in compression, the widened body of the connection element bears against a surface of the coupling member. In traction, the widened head of the connection member bears against the opposite surface of the coupling member. Preferably, the height dimension of the neck between the widened body and head is generally the same as the thickness dimension of the slit. In this way, little or no play is present between the connection element and the coupling member, whereby a reliable and rattle-free device is obtained.

Preferably, an adjustable connection between a connection element and a coupling member allows displacements in a plane which is parallel with respect to both pivot axes. Also, a connection element may be fixedly connected to one of the coupling members. The other connection allows the desired adjustability of the connection element. Furthermore, both connections of a connection element may be carried out as adjustable connections.

The universal joint between the coupling members may optionally be carried out with an intermediate member which is coupled to one of the coupling members through one of the pivots and which is coupled to the other of the coupling members through the other pivot. Preferably, the connection elements comprise a rubber material.

The connection elements may be positioned at different locations with respect to the coupling members. According to a first possibility, the connection elements are positioned at a distance from at least one of the axes. Thus, the compression or elongation of the connection elements and thereby the overall stiffness of the rotary disc head can be influenced by selecting such position.

The invention is furthermore relates to a floor treatment machine, comprising a body with an electric drive, at least three rotary drive elements, transmission means between the electric drive and the drive elements as well as rotatable disc heads as described before mounted onto the drive elements. The rotatable disc heads are each provided with a floor treatment element, such as a grinding disc or polishing disc.

The invention will now be described further with reference to an embodiment shown in the drawings.

DETAILED DESCRIPTION OF THE INVENTION

Figure 1:
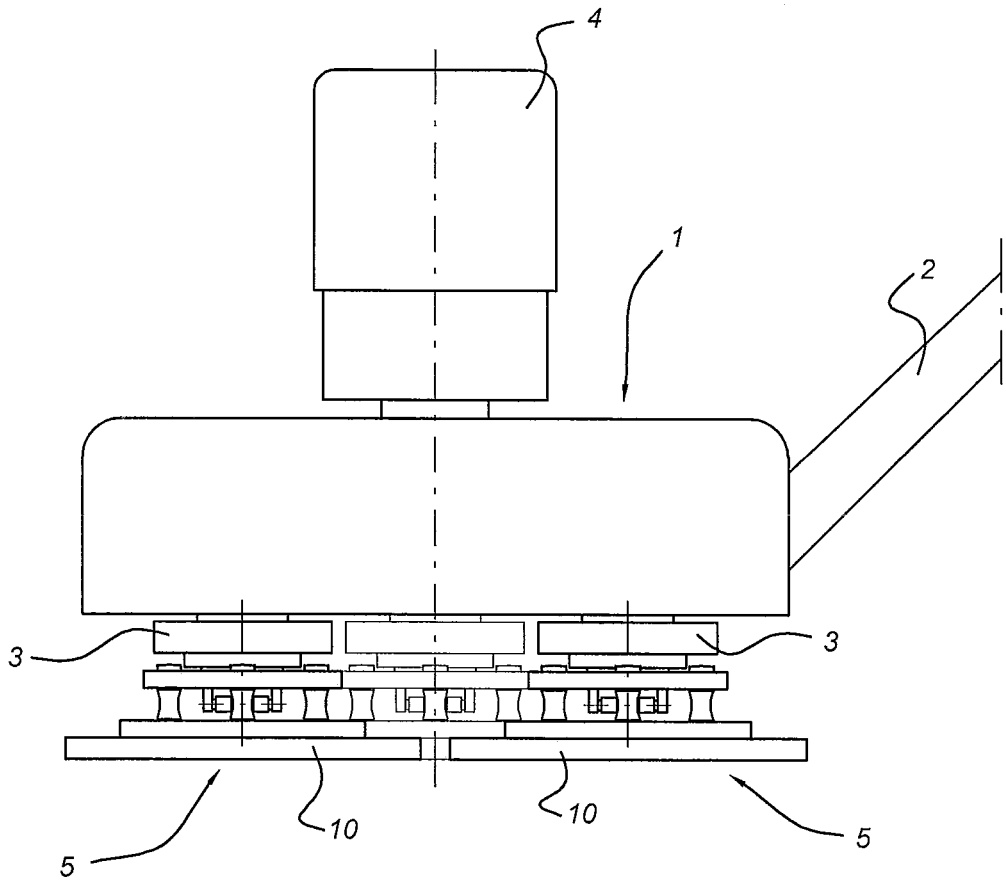
FIG. 1 shows an overview of a floor treating machine.

A floor treating machine as shown in FIG. 1 comprises a housing 1, onto which a steering lever 2 is mounted for directing the floor treating machine over a floor to be treated. The floor treating machine 1 has three rotors 3 which are evenly distributed in circumferential direction of the housing 1. Said rotors 3 are rotatably suspended with respect to the housing 1, and are driven in rotation by an electric motor 4 through a transmission which is located in the housing. Said transmission is known in the art, and will not be described further. By means of said transmission, the rotors 3 can be driven in the same rotational direction.

Figure 2:
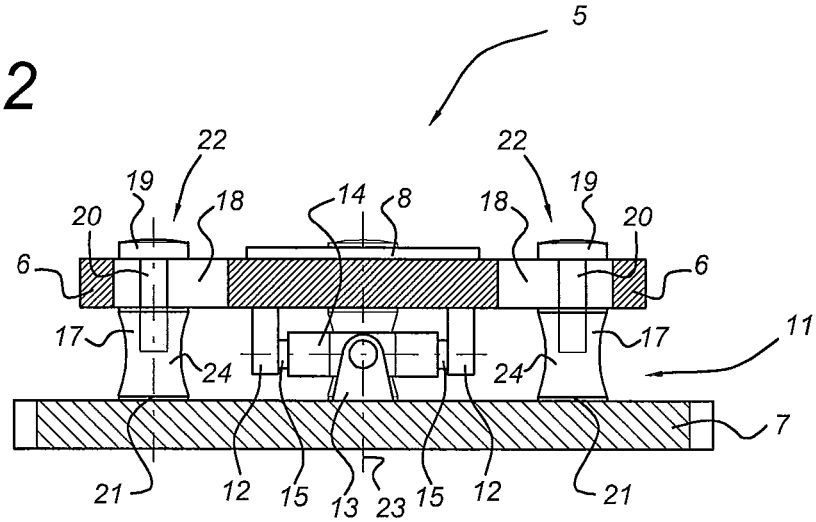
FIG. 2 shows a rotary disc head according to the invention mounted on the machine of FIG. 1.

Onto each rotor, a rotary disc head 5 according to the invention is mounted. An example of such rotary disc head is shown in FIG. 2. The rotary disc head shown there comprises tow coupling members 6, 7, The upper coupling member 6 has fitting means 8 through which the rotary disc head can be fitted onto a rotor 3. The lower coupling member 7 has carrier means 9 onto which a polishing or grinding disc can be mounted. These discs are in contact with the floor to be treated, which means that they have to adapt their orientation to the conditions of the floor. Such floor may exhibit an uneven surface, in such a way that the discs sometimes are unable to contact the floor over their full surface. This is undesirable, as the floor will then be treated in an uneven manner leading to a poor result.

With the aim of mitigating the contact problem of the polishing or grinding disc on an uneven floor, the rotary disc head comprises a cardan like coupling 11 between the coupling members. This cardan coupling or universal coupling consists of a pair of bearings 12 mounted on the lower side of upper coupling member 6 and a pair of bearings 13 (one of which is visible in FIG. 2) mounted on the upper side of the lower coupling member 7. Furthermore, the cardan coupling has an intermediate member 14 which has a first pair of opposite axle stubs 15 which are rotatably supported by means of the pair of bearings 12 mounted to the upper coupling member 6, and a second pair of axle stubs 16 (one of which is visible in FIG. 2) which are generally oriented perpendicularly with respect to the other pair of axle stubs 14 and which are rotatably supported by means of the bearings 1 mounted on the lower coupling member 7.

Figure 3:
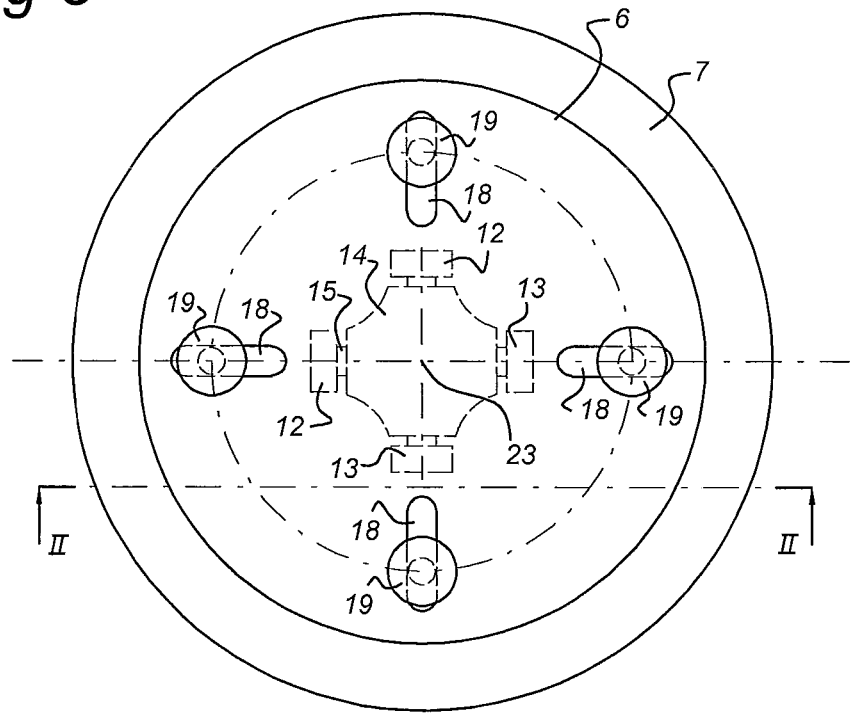
FIG. 3 shows a top view of the rotary disc head according to III of FIG. 2.

The polishing disc 10 which is mounted to the lower coupling member 7 can adjust itself now to the shape of the floor under treatment as a result of the tilting around the pairs of axle stubs 15, 16. However, the tilting movements in combination with the rotary action of the rotary disc head are vulnerable with respect to uncontrolled phenomena such as vibrations. Moreover, it is desirable that the polishing discs 10 be held in a horizontal, neutral position and are urged to reach that position after a deflection has occurred. The effect of damping any vibrations and of urging the discs towards the neutral position is accomplished by means of the elastic connection elements 17, two of which are visible in FIG. 2. These elastic connection elements 17 may consist for instance of rubber; other materials or coil springs are however possible as well. The elastic connection elements according to the invention are fixedly connected to one of the coupling members, in the example shown the fixed connection 21 to the lower coupling member 7. This fixed connection 21 can for instance be obtained by means of a screw which engages a nut part of the elastic connection element 17. As shown in the top view of FIG. 3, four connection elements have been supplied although other numbers are possible as well.

The elastic connection elements 17 are loaded both in compression as well as in traction; for this reason the connection elements are to be connected to both coupling members 6, 7 in such a way that compression and traction forces can be transferred. However, in case a relative tilting of the coupling members with respect to each other occurs, the connection elements are not only loaded in compression and/or traction, but also in shear. The forces which are caused by these shear loading are undesirable, as they lead to an unpredictable behavior of the connection elements.

For this reason, the other connection of each connection element 17 is carried out as a slidable connection 22. This slidable connection comprises a relatively narrow neck 20 and a widened head 19 on the upper end of the connection element, and a slit 18 in the upper coupling member 6. The width of this slit 18 is about the same as the corresponding width of the neck 20, and smaller than the width of the widened head 19, the height of the neck is about the same as the thickness of the slit 18. thus, the connection element 17 can still be loaded both in compression and traction. In the case of traction, the widened head 19 bears against the upper coupling member; in the case of compression the body 24 of the connection element 17 bears against the upper coupling member.

Figure 4:
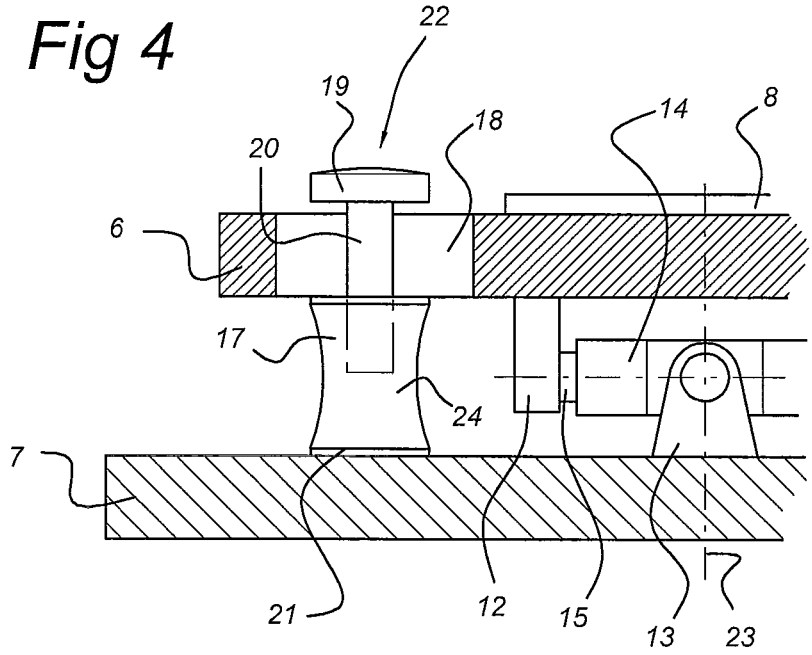
FIG. 4 shows a detail of the rotary disc head in nominal position, according to IV-IV of FIG. 3.
Figure 5:
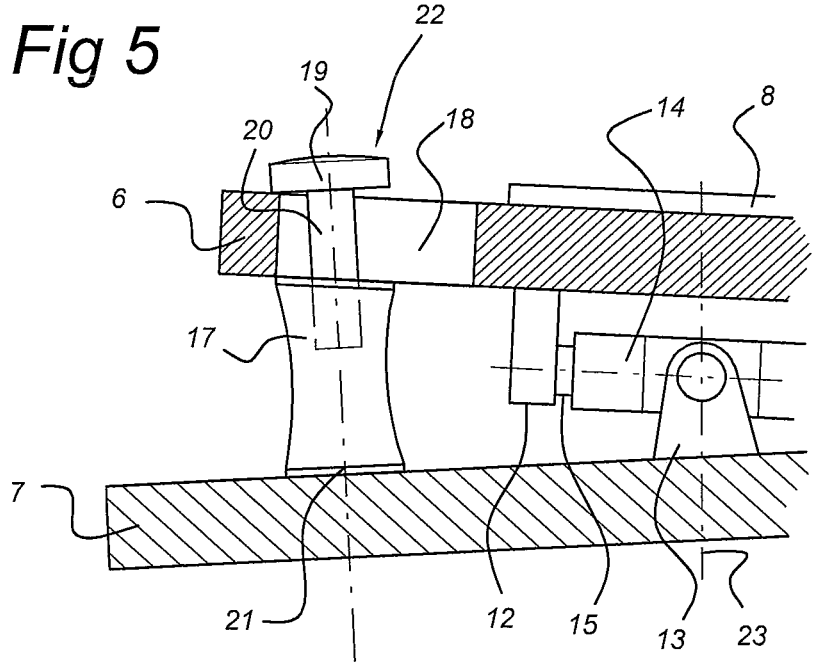
FIG. 5 shows a detail of the rotary disc head in deflected position.

During the process of treating a fully flat floor part, the coupling members 6, 7 are generally parallel shown in FIG. 4. As soon as a somewhat non-flat floor part is reached, the lower coupling member 7 starts to tilt with respect to the upper coupling member as shown in FIG. 5. In this state, the intermediate member 14 starts to rotate back and forth around the stub axles 15 and 16. Each connection elements is alternately loaded in compression and traction whereby the slidable connection provides the possibility for the connection elements to move the location with respect to the upper coupling member 6 without being loaded in shear. The neck 20 slides back and forth through the slit 18, while the head travels back and forth as well over the upper surface of the upper coupling member 6.

LIST OF REFERENCE NUMERALS

1. Housing
2. Steering bar
3. Rotor
4. Motor
5. Rotary disc head
6. Upper coupling member
7. Lower coupling member
8. Fitting means
9. Carrier means
10. Treatment disc
11. Universal coupling
12. Bearing
13. Bearing
14. Intermediate member
15. Axle stub
16. Axle stub

17. Connection element
18. Slit
19. Widened head
20. Neck
21. Fixed connection
22. Slidable connection
23. Axis of rotatable disc head
24. Body of coupling member

The invention claimed is:

1. A rotatable disc head for a floor treatment device, the rotatable disc head comprising:

a pair of coupling members pivotably connected to each other according to pivot axes transversely oriented with respect to each other, a rotation axis transversely oriented with respect to said pivot axes, said coupling members being furthermore connected to each other by means of at least one elastically deformable connection element, wherein one of the coupling members comprises fitting means for mounting said coupling member to a rotary drive of the floor treatment device and the other coupling member comprises carrier means onto which a floor treatment element can be mounted, wherein an intermediate member is provided which is coupled to one of the coupling members through one of the pivots and which is coupled to the other of the coupling members through the other pivot, wherein multiple connection elements are provided at a distance from at least one of the pivot axes, and wherein a connection between the connection element and one coupling member are slideable connections allowing displacements which are oriented transversely with respect to the rotation axis.

2. The rotatable disc head according to claim 1, wherein an adjustable connection of the connection element and one of the coupling members comprises a slit.

3. The rotatable disc head according to claim 2, wherein the slit is oriented perpendicular with respect to one of the pivot axes.

4. The rotatable disc head according to claim 2, wherein the slit is oriented obliquely with respect to the pivot axes at an angle of 45 degrees.

5. The rotatable disc head according to claim 4, wherein the height dimension of the neck between the widened body and the head is generally the same as the thickness dimension of the slit, seen in direction perpendicular with respect to the coupling member containing the slit.

6. The rotatable disc head according to claim 1, wherein the connection element comprises a relatively narrow neck bordered by a widened body and a widened head and one of the coupling members has a slit the width of which is smaller than the width of the widened body and the head, said slit slideably accommodating the relatively narrow neck of the connection element.

7. The rotatable disc head according to claim 1, wherein the connection elements comprise a rubber material.

8. The rotatable disc head according to claim 1, wherein an adjustable connection between at least one connection element and one coupling member allows displacements in a plane which is parallel with respect to both pivot axes.

9. The rotatable disc head according to claim 1, wherein at least one connection element is fixedly connected to one of the coupling members.

10. A floor treatment machine comprising:

a body with an electric drive, at least three rotary drive elements, transmission means provided between the electric drive and the drive elements; and a plurality of rotatable disc heads comprising:

a pair of coupling members pivotably connected to each other according to pivot axes transversely oriented with respect to each other, a rotation axis transversely oriented with respect to said pivot axes, said coupling members being furthermore connected to each other by means of at least one elastically deformable connection element, wherein one of the coupling members comprises fitting means for mounting said coupling member to a rotary drive of the floor treatment device and the other coupling member comprises carrier means onto which a floor treatment element can be mounted, wherein an intermediate member is provided which is coupled to one of the coupling members through one of the pivots and which is coupled to the other of the coupling members through the other pivot, wherein multiple connection elements are provided at a distance from at least one of the pivot axes, and wherein a connection between the connection element and one coupling member are slideable connections allowing displacements which are oriented transversely with respect to the rotation axis, and wherein the plurality of rotatable disc heads are mounted onto the drive elements.

11. The floor treatment machine according to claim 10, wherein the rotatable disc heads are each provided with a floor treatment element.

12. The floor treatment machine according to claim 11, wherein the floor treatment element is a grinding disc or a polishing disc.

* * * * *